US008234979B1

(12) United States Patent
Falabella et al.

(10) Patent No.: US 8,234,979 B1
(45) Date of Patent: Aug. 7, 2012

(54) 3D SHOCK ISOLATION APPARATUS WITH ACCESS TO ONE END OF A BODY

(75) Inventors: David J. Falabella, Merritt Island, FL (US); Gary A. Simpson, Apopka, FL (US); Jonathan Dwight Wehking, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 226 days.

(21) Appl. No.: 12/772,658

(22) Filed: May 3, 2010

Related U.S. Application Data

(60) Provisional application No. 61/174,749, filed on May 1, 2009.

(51) Int. Cl.
*F42B 12/00* (2006.01)
*F42B 30/00* (2006.01)

(52) U.S. Cl. ..... 102/499; 102/473; 102/275.9; 102/396; 102/501

(58) Field of Classification Search ..... 102/275.9, 102/216, 265, 266, 271, 396, 473, 499, 200, 102/501
See application file for complete search history.

(56) References Cited

U.S. PATENT DOCUMENTS

| | | | | |
|---|---|---|---|---|
| 7,549,374 | B2 * | 6/2009 | Schwantes et al. | 102/275.9 |
| 7,552,682 | B2 * | 6/2009 | Schwantes et al. | 102/275.9 |
| 7,802,518 | B2 * | 9/2010 | Schwantes et al. | 102/275.9 |
| 7,814,834 | B2 * | 10/2010 | Schwantes et al. | 102/275.9 |
| 7,971,533 | B1 * | 7/2011 | Berlin et al. | 102/275.9 |
| 8,161,881 | B2 * | 4/2012 | Brooks et al. | 102/275.9 |
| 2009/0205527 | A1 | 8/2009 | Brooks et al. | |
| 2009/0211481 | A1 | 8/2009 | Schwantes et al. | |

* cited by examiner

*Primary Examiner* — James Bergin
(74) *Attorney, Agent, or Firm* — Jetter & Associates, P.A.

(57) ABSTRACT

An apparatus for shock isolating an electronics package includes an outer member including an internal threaded portion and a transition member including an external threaded portion and a hollow inner portion that defines a cavity configured for receiving the electronics package. A layer of mechanically compliant shock isolation material is positioned between the inner thread portion of the outer member and the external thread portion of the transition member. The compliant shock isolation material encloses a front end and sidewalls of the transition member and is absent from its aft end to allow access to one end of the electronics package (e.g. to a connector). The internal threaded portion of the outer member and the external threaded portion of the transition member are compliantly engaged via a gap provided by the layer of compliant shock isolation material. In one embodiment the electronics package is a fuze assembly.

20 Claims, 7 Drawing Sheets

3D SHOCK ISOLATION APPARATUS WITH ACCESS TO ONE END OF A BODY

CROSS REFERENCE TO RELATED APPLICATIONS

This application claims the benefit of Provisional Application Serial No. 61/174,749 entitled "APPARATUS FOR PROVIDING A BODY 3D SHOCK ISOLATION UNDER HIGH DECELERATION WHILE ALLOWING ACCESS TO ONE END OF THE BODY", filed May 1, 2009, which is herein incorporated by reference in its entirety.

FIELD

Disclosed embodiments relate to shock isolation for bodies that generally include electronics, such as fuzes.

BACKGROUND 3D shock isolation is needed for bodies while allowing access to one end of the body, such as to make electrical and/or mechanical connections to existing connections thereto for a variety of applications. Exemplary applications include for instrumentation packages that are dropped from high altitude (e.g., weather instrumentation, remote environmental sensors), onboard recorded packages for high-g launch and impact events, and isolation of gun launched inertial navigation units.

3D shock isolation is also needed for fuzes for certain explosives. The use of explosive weapons and fuzes is known in the art. In an explosive, pyrotechnic device or military munition, a fuse (or fuze) is the part of the device that initiates its function and ensures that they do not initiate (explode) prematurely. When used in a military context, the term fuse describes a simple pyrotechnic initiating device, whereas the term fuze is used to indicate a more sophisticated ignition device incorporating mechanical and/or electronic components. A munition fuze assembly may contain a small amount of primary explosive to initiate the detonation. Fuze assemblies for large explosive charges may also include an explosive booster.

In general, a munition has to travel a certain distance, wait for a period of time (e.g., timed via a clock, or electronic, or a chemical delay), or have some form of arming pin/plug removed. One particular fuze category is an impact, percussion or contact fuze (referred to herein as an "impact fuse") which detonates when their forward motion rapidly decreases, typically on physically striking an object such as the target. Only when these processes have occurred should the arming process be complete. However, high impact shock events can cause premature detonations.

SUMMARY

One known approach to 3D shock isolation for bodies that generally include electronics is full encapsulation in some complaint material. However, full encapsulation is not practical for legacy electronics packages that also need access to existing connections that are un-isolated. For example, encapsulating legacy fuzes in shock isolation material is not generally practical due to required installation procedures and access to the aft end of the fuze needed for fuze lanyards and electrical connections.

Disclosed embodiments generally solve this problem by disclosing an apparatus for shock isolating an electronics package comprising an outer member including an internal threaded portion, and a transition member including an external threaded portion and a hollow inner portion that defines a cavity configured for receiving the electronics package. A layer of mechanically compliant shock isolation material is positioned between the inner thread portion of the outer member and the external threaded portion of the transition member. As used herein, a "mechanically compliant shock isolation material" hereafter a "compliant material" refers to a material that has a Young's modulus at 25° C. of $\leqq$1 GPa ($10^9$ N/m$^2$=1 GPa). The compliant material encloses one end and sidewalls of the transition member and is absent from its other end to leave the other end exposed to allow access thereto.

The internal threaded portion of the outer member and the external threaded portion of the transition member are compliantly engaged via a gap provided by the layer of compliant material to protect the electronics package in all three axes (thus providing 3D protection), while leaving one end of the electronics package accessible. In one embodiment, the electronics package comprises a fuze. In this embodiment, the existing connection needing connection thereto is the aft end to a FZU connector which connects to a FZU arming device.

DETAILED DESCRIPTION

Figure 1:
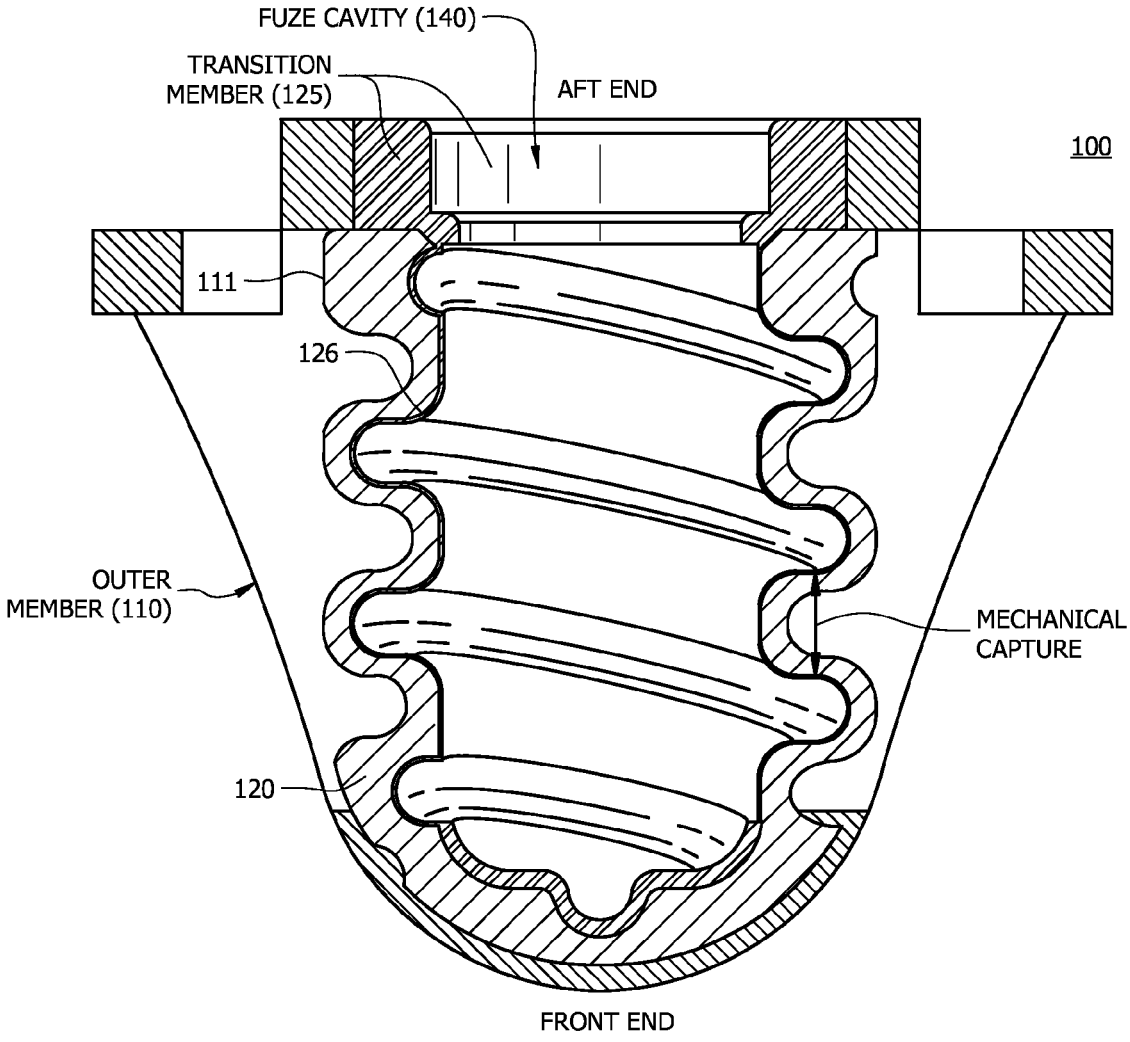
FIG. 1 is a cross-sectional depiction of an exemplary shock isolated apparatus that is adapted for receiving and securing an electronics package and providing access to the aft end of the electronics package, according to an embodiment of the invention.

Disclosed embodiments are described with reference to the attached figures, wherein like reference numerals, are used throughout the figures to designate similar or equivalent elements. The figures are not drawn to scale and they are provided merely to illustrate aspects disclosed herein. Several disclosed aspects are described below with reference to example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. Disclosed embodiments are not limited by the illustrated ordering of acts or events, as some acts may occur in different orders and/or concurrently with other acts or events. Furthermore, not all illustrated acts or events are required to implement a methodology in accordance with this Disclosure.

Notwithstanding that the numerical ranges and parameters setting forth the broad scope of this Disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

As described above, fully encapsulating legacy electronics packages that need shock isolation protection in shock isolation material is not generally practical due to required installation procedures and access to one end of the electronics packages, such as the aft end for fuze lanyards and electrical connections for fuzes. Disclosed embodiments solve this problem by disclosing an apparatus that includes an outer member including an internal threaded portion and a transition member including an external threaded portion and a hollow inner portion that defines a cavity configured for receiving the electronics package.

A layer of compliant material is positioned between the inner threaded portion of the outer member and the external threaded portion of the transition member. The compliant material encloses a front end and sidewalls of the transition member and is absent one of its ends to allow access thereto, such as to an electrical connector. The internal threaded portion of the outer member and the external threaded portion of the transition member are compliantly engaged via a gap provided by the layer of compliant material to protect the electronics package in all three axes (providing 3D protection), while leaving one end of the electronics package accessible.

Referring to FIG. 1, a cross-sectional depiction of an exemplary shock isolated apparatus 100 is shown that is adapted for receiving and securing an electronics package and providing access to one of its ends, according to an embodiment of the invention. Apparatus 100 includes an outer member 110 including an internal threaded portion 111. A transition member 125 includes an external threaded portion 126 and a hollow inner portion that defines a cavity 140 configured for receiving the electronics package. Outer member 110 and transition member 125 are both generally metal comprising, and can be a form of steel in one embodiment.

A layer of compliant material 120 is positioned between the inner threaded portion 111 of the outer member 110 and the external threaded portion 126 of the transition member 125. Compliant material 120 can comprise a variety of material, such as a polymeric material (e.g., an elastomer) or a soft metal. For example and without limitation, the polymeric material may be a silicone, a fluorocarbon elastomer, a flexible epoxy, a flexible polyimide, a polyurethane, a rubber material, and combinations of one or more of the foregoing, and so forth. Alternatively, the layer of compliant material 120 may be a soft metal such as, for example and without limitation, indium, an indium alloy, Woods metal, a bismuth alloy, Babbett metal, a lead alloy, a tin alloy, and Indalloy materials (available from Indium Corporation of America, Utica, N.Y.), Kapp AgSn (available from Kapp Alloy and Wire, Inc., Oil City, Pa.), combinations of one or more of the foregoing, and other soft metals.

The thickness range for the compliant material 120 is generally governed by allowable shear capabilities of the material and the magnitude of loads isolated. To minimize a shear failure, the thickness of the compliant material 120 may be based on the degree of overlap of the inner and out helical surfaces as described below.

In the embodiment shown the compliant material 120 encloses a front end and sidewalls of the transition member 125 and can be seen to be absent from its aft end to leave the aft end exposed to allow access thereto. The internal threaded portion 111 of the outer member 110 and the external threaded portion 126 of the transition member 125 are compliantly engaged via a gap (i.e. distance) provided by the thickness of the layer of compliant material 120.

The engagement between the outer member 110 and transition member 125 is a threaded engagement, but is not threaded in the traditional sense where two bodies are captured and held in place with a preload. Outer member 110 and transition member 125 are "loosely threaded" to one another so that there is a gap between the transition member 125 and the outer member 110 that is filled with the compliant material 120. The threaded arrangement is generally analogous to a screw/nut threading to accommodate support of the compliant material 120 in 3D to capture this material to prevent it from exiting the outer member 110 with rebound responses after an initial impact. Arrangements other than threaded arrangements can also be used such as a two (2) clam shell halved arrangement provided the 3D capture of the compliant material 120 is provided. However, this alternate design is structurally not as efficient as compared to the disclosed threaded arrangement.

As known in threaded fastener technology, a screw thread, often abbreviated thread, is a helical structure, where the helix of a thread can twist in two possible directions, which is known as handedness. Disclosed embodiments can use either handedness. A screw thread can be represented as a ridge wrapped around a cylinder or cone in the form of a helix, with the former being called a straight thread and the latter called a tapered thread, with disclosed embodiments able to use either. The cross-sectional shape of a thread for internal threaded portion 111 and external threaded portion 126 may be a variety of shapes including square, rounded square triangular, semi-circular, trapezoidal, or other shapes. More generally, the threads can be any cross-sectional shape (or combination thereof) so long as the outer member 110 and the transition member 125 are mechanically captured (overlap between the threads) leaving room for a sufficient amount of compliant material 120 to fill in the empty space.

Figure 2:
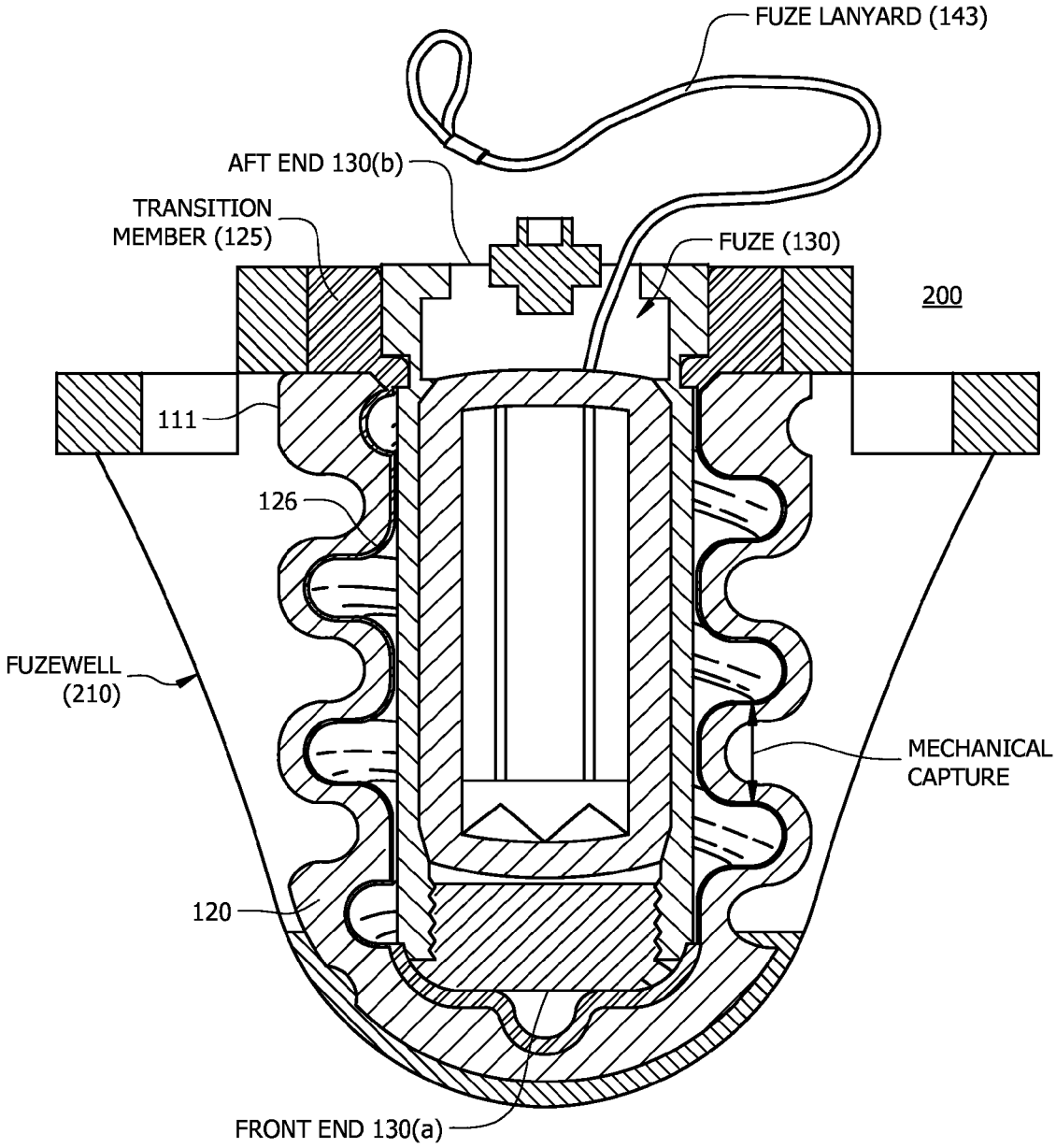
FIG. 2 shows a cross sectional depiction of an exemplary shock isolated fuze assembly comprising the apparatus shown in FIG. 1 having a fuze secured thereto that provides access to the aft end of the fuze, according to an embodiment of the invention.

FIG. 2 shows a cross sectional depiction of an exemplary shock isolated fuze apparatus 200 comprising apparatus 100 shown in FIG. 1 having a fuze 130 in cavity 140 that provides access to the aft end of the fuze, according to an embodiment of the invention. Outer member 110 shown in FIG. 1 is shown as fuzewell 210 in FIG. 2. Notably, the fuze 130, even when it is a legacy fuze, can remain unmodified. As used herein a "legacy fuze" refers to a fuze design that was not built with the forethought of using fully enclosed (i.e. fully encapsulating) shock isolation technology. "Legacy fuzes" thus need some method of accessing pre-existing un-isolated connections without modification to the inner isolated fuze package.

Fuze 130 comprises a front end 130(*a*) and an aft end 130(*b*). The aft end 130(*b*) of the fuze 130 is secured to the transition member 125 via a suitable retaining element. The retaining element is generally furnished with the legacy fuze used for compression mount (e.g., compression mount arrangement). However, other types of mounting arrangements and retaining elements can also be utilized. A fuze lanyard 143 is shown coupled to the aft end 130(*b*) of the fuze 130. Connection will also generally be made to front end of fuze 130, and this can be accomplished by passing a thin harness (e.g., a flat flex harness or a number of discrete wires) along the length of the fuze 130 out the aft end 130(*b*).

Although hydrostatic balance techniques described below relative to FIG. 3 have been shown by the Inventors to increase fuze survivability for impact fuzes by up to about 3×-5× by reducing shock on impact, such techniques are most effectively utilized when the electronics package or object being protected (e.g., a fuze) is floated in a compliant material which provides complete encapsulation. However, as described above, legacy fuzes require access to a FZU arming device through the aft end of the fuze, making retrofitting via complete encapsulation not possible without a major redesign of the fuze 130. Apparatus 200 overcomes this problem by not fully encapsulating fuze 130 with compliant material 120, so as to provide access its aft end 130(*b*), while also mechanically capturing the compliant material 120 to prevent it from exiting the fuzewell 110 with rebound responses after an initial impact with a target.

The compliant material 120 between the transition member 125 and the fuzewell 210 provides a mechanical floating condition for the fuze 130, but is absent from the aft end 130(*b*) of the fuze 130 to allow access to a connector (e.g., a FZU connector). The floating condition provided protects the fuze 130 and thus helps avoid the associated munition that generally has a power source (e.g., a FZU) mounted on its skin from exploding prematurely, such as due to HDBT penetration.

As enemy targets are becoming increasingly advanced and as a result are more challenging to prosecute, such as those classified as Hard and Deeply Buried Targets (HDBT), there is a desire to modify existing weapons to make them capable of pursuing these targets. HDBTs can subject fuzes to very severe shock environments. While the average deceleration of the weapon may be on the order of 5,000 g, high frequency shocks over 10 times this level may be experienced by the fuze in all three (3) axes due to non-homogeneity of certain targets, and a variety of higher order structural modes of the weapon assembly.

In such embodiments, the compliant material 120 can comprise a mixture including at least one compliant material (e.g. an elastomer) and at least one material that is generally non-compliant (e.g. metal) to provide a hydrostatic balance with the combination of the transition member and the fuze material (e.g., steel). The Inventors have realized that traditional elastomeric or metallic isolation system materials that would normally be used to attenuate and absorb high frequency component of a shock would fail structurally or bottom out under the large average deceleration forces present during a HDBT penetration event.

As disclosed herein, the compliant material that surrounds the fuze is tailored in density to substantially match the density of the combination (combined density) of the transition member and fuze (or more generally the electronic package) to limit these forces to stay within the stress/strain capabilities of the complaint material. As used herein, substantially matching in density refers to densities being within 20%, and typically within 10%. An example would be to mix very fine metal (e.g., tungsten) powder into an elastomeric material until its density was close or equal to the density of the transition member and the fuze (or more generally the electronic package), and/or to alter its chemical composition increase its density. This density matching will result in "floating" the fuze in the compliant material. While this will reduce the higher frequency components of the component shock due to higher order modes in the fuze (or more generally the electronic package) and mount assembly, it will transmit most or all of the base rigid body motion. The thickness of the compliant material on the sides, top and bottom can be varied to tailor the system response in each different axis.

Figure 3:
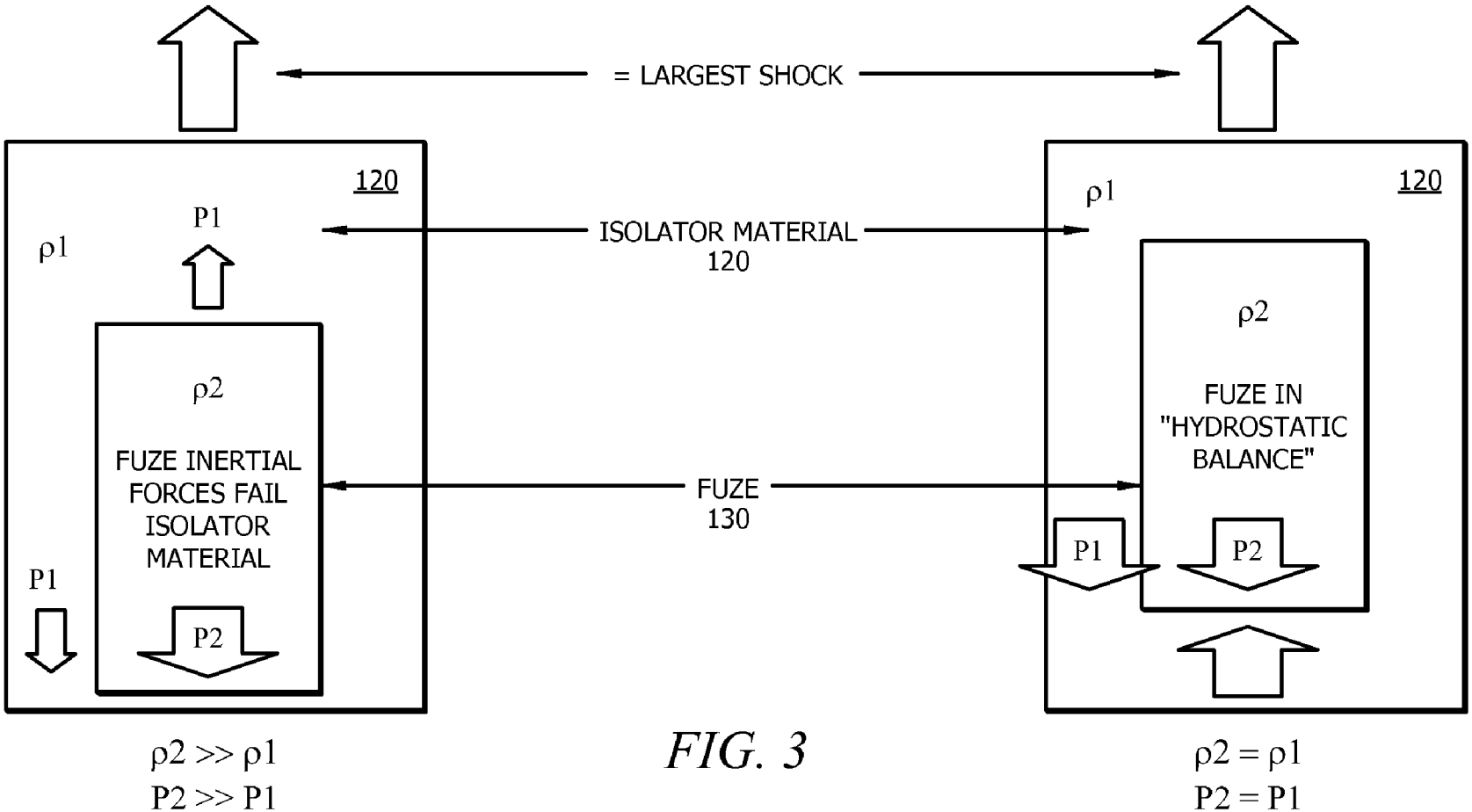
FIG. 3 is a depiction of operation of hydrostatic balance that significantly reduces or eliminates the large inertial forces on the compliant material generated by weapon-based deceleration and other rigid body modes by providing a compliant material that has a density that at least nearly matches the density of the combination comprising the transition member and the fuze so that it is in hydrostatic balance, according to a disclosed embodiment.

FIG. 3 is a depiction of operation of hydrostatic balance as disclosed herein that can significantly reduce or eliminate the large inertial forces on the compliant material generated by the weapon upon impact with a target based on deceleration and other rigid body modes raising the density of the compliant material 120 so that it is in hydrostatic balance with the transition member 125, fuze 130, and other isolated components. As shown, by matching density $\rho$ (e.g., $\rho_1=\rho_2$), the shear and compression loads on the compliant material are reduced to avoid failure of the isolation system.

Generally, any combination of materials that form a semi-homogeneous mixture that comprises a compliant material that thus provide significant flow under stress (e.g. elastomer), suspending an additional component that raises the density of the resulting mixture can be used for density matching. In one embodiment, a metal powder is provided with an elastomer to form a mixture to increase the density above that of the elastomer to approach the density of the transition member 125 and fuze 130, which can be steel having a density of about 7,800 kg/m$^3$. One exemplary metal particle is a tungsten particle. However, other metal particles, or other particles having densities comparable to most metals, can also be used.

Figure 4:
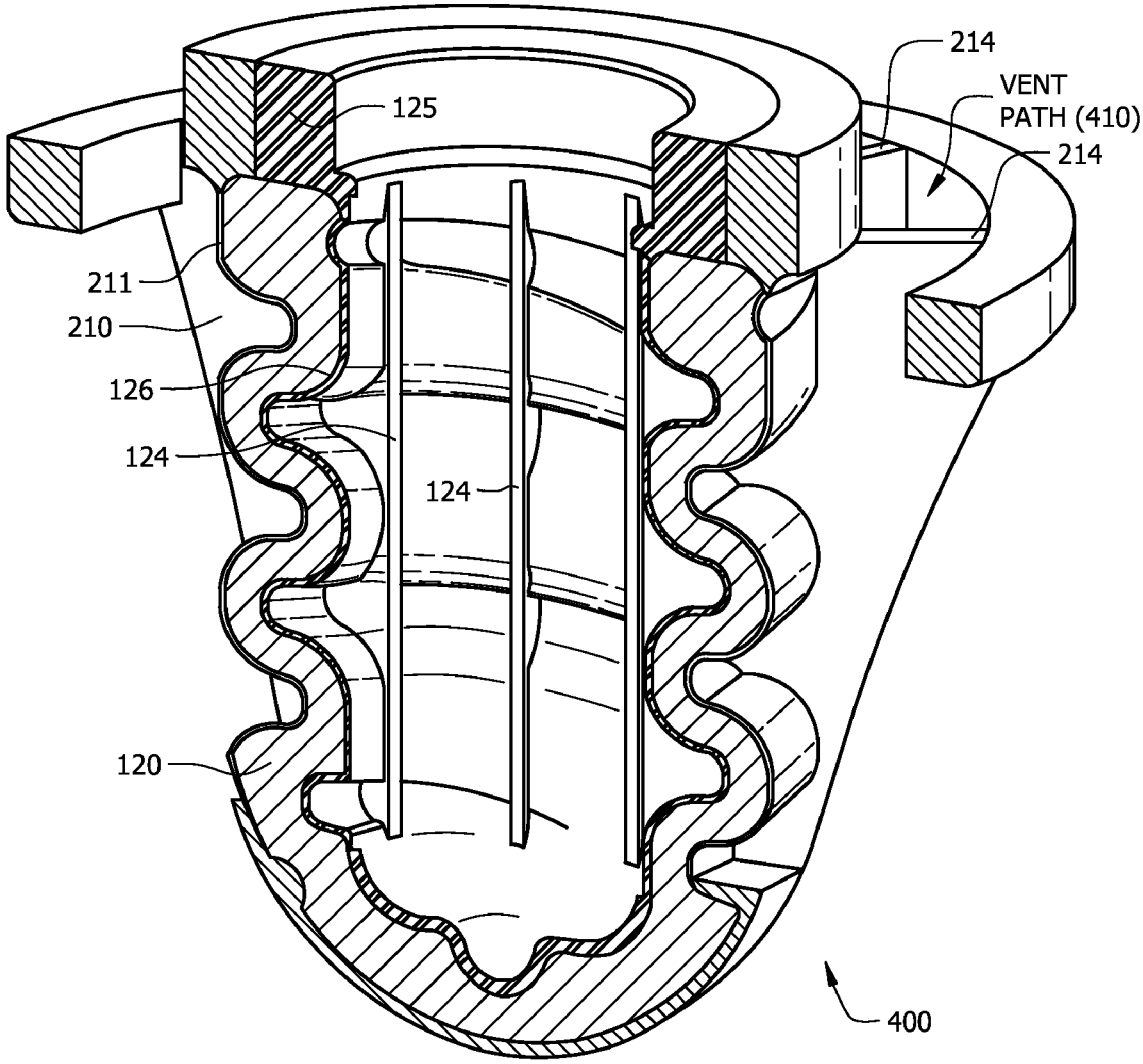
FIG. 4 is a cross sectional depiction through a non-ribbed slice of an exemplary shock isolated apparatus that includes supporting ribs, according to a disclosed embodiment.

FIG. 4 is a cross sectional depiction through a non-ribbed slice of an exemplary shock isolated apparatus 400 that includes supporting ribs, according to a disclosed embodiment. The Inventors have recognized that lessening the weight of the inner isolated structure (fuzewell 210 and transition member 125) is helpful for fuze applications. The lowering of the mass reduces the inertial load required to be reacted by the compliant isolation material 120. The outer structure would generally become prohibitively heavy unto itself to maintain structural integrity without lightening the weight through hollowing the threads which is enabled by reinforcing with ribs as described herein.

The threads in the internal threaded portion 111 of the outer member 110 and the threads in the external threaded portion 126 of the transition member 125 are thin walled, such as being shell-like that is characterizable by a shell thickness. As used herein "thin walled" corresponds to a thickness between 20 and 200 mils, typically being 60 to 125 mils. The fuzewell 210 and transition member 125 can be seen to include a plurality of longitudinal ribs 214 (external ribs) and 124 (internal ribs), respectively, for adding mechanical strength. The rib thickness and shell thickness for the outer member and transition member are dimensioned in a similar way, but similar does not necessarily mean the same numerical dimensions. The helix shell thickness shown in FIG. 4 refers to the material thickness on either side of the thin walled threads. Munition vent paths 410 are also shown in FIG. 4.

Figure 5:
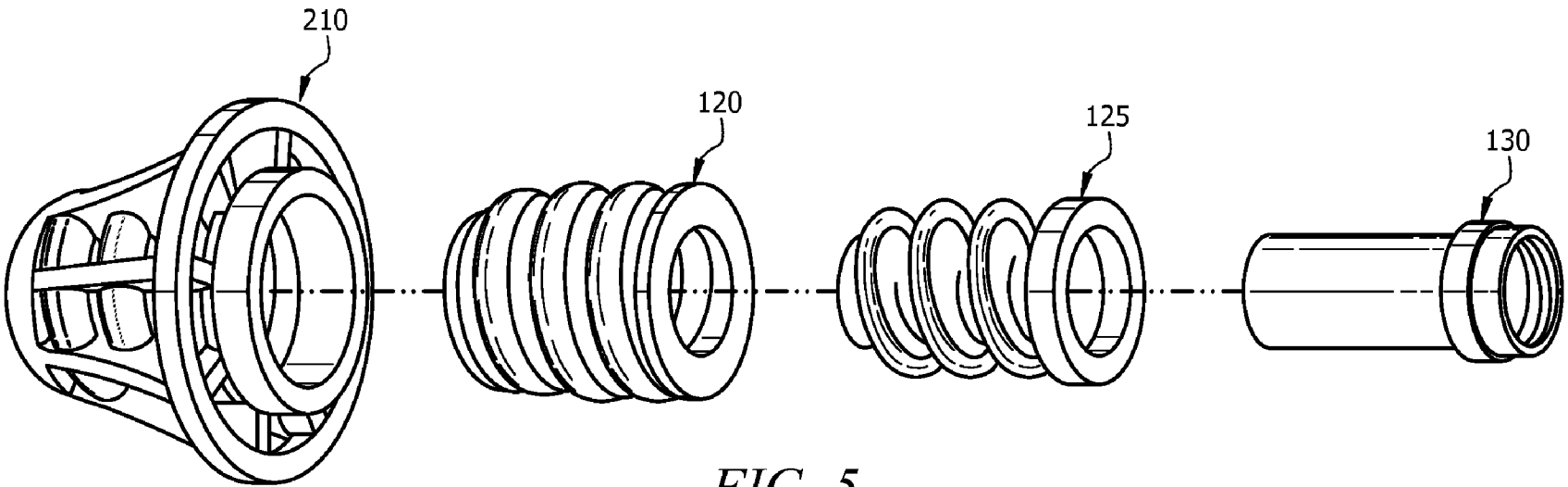
FIG. 5 shows a depiction of an exemplary fuze assembly process that secures a legacy fuze to a shock isolated fuzewell apparatus, according to an embodiment of the invention.

FIG. 5 shows a depiction of an exemplary fuze assembly process that secures a legacy fuze 130 to a shock isolated fuzewell apparatus, according to an embodiment of the invention. The fuzewell 210 and transition member 125 shapes (e.g., both helical) can be formed by casting using suitable molds. Other methods for formation include complex machining operations or a sintering process. Generally the least expensive method is the casting method.

A legacy fuze 130 can be installed into the transition member 125 via its own retainer. As described above for legacy fuze applications, the legacy fuze retainer is used for a compression mount. The legacy fuze 130/transition member 125 can then be threaded into the fuzewell 210 (e.g., using the fuzewell's helical feature) that is lined with a layer of compliant material 120. The compliant material 120 can be applied by molding in place, but provisions can be made for a pre-mold and screw assembly. The aft end of the fuze 130 remains exposed and is thus able to be connected to a FZU device on the skin of the weapon, for example. In one embodiment, the transition member 125 be threaded into the fuzewell 210 and thereafter the fuze 130 is be inserted into the transition member 125 and secured.

The layer of compliant material 120 is between the two threaded bodies 210/125, which contain thread overlap (positive mechanical capture) due to their helical features, thus giving the fuze 130 its floating condition. The helical/threaded design also allows for ease of assembly, and the prevention of unwanted breaks in shock isolation material as is the nature with a conventional clamshell design in which small breaks in the vessel will cause the layer of compliant material 120 material to squirt out upon weapon impact.

Figure 6:
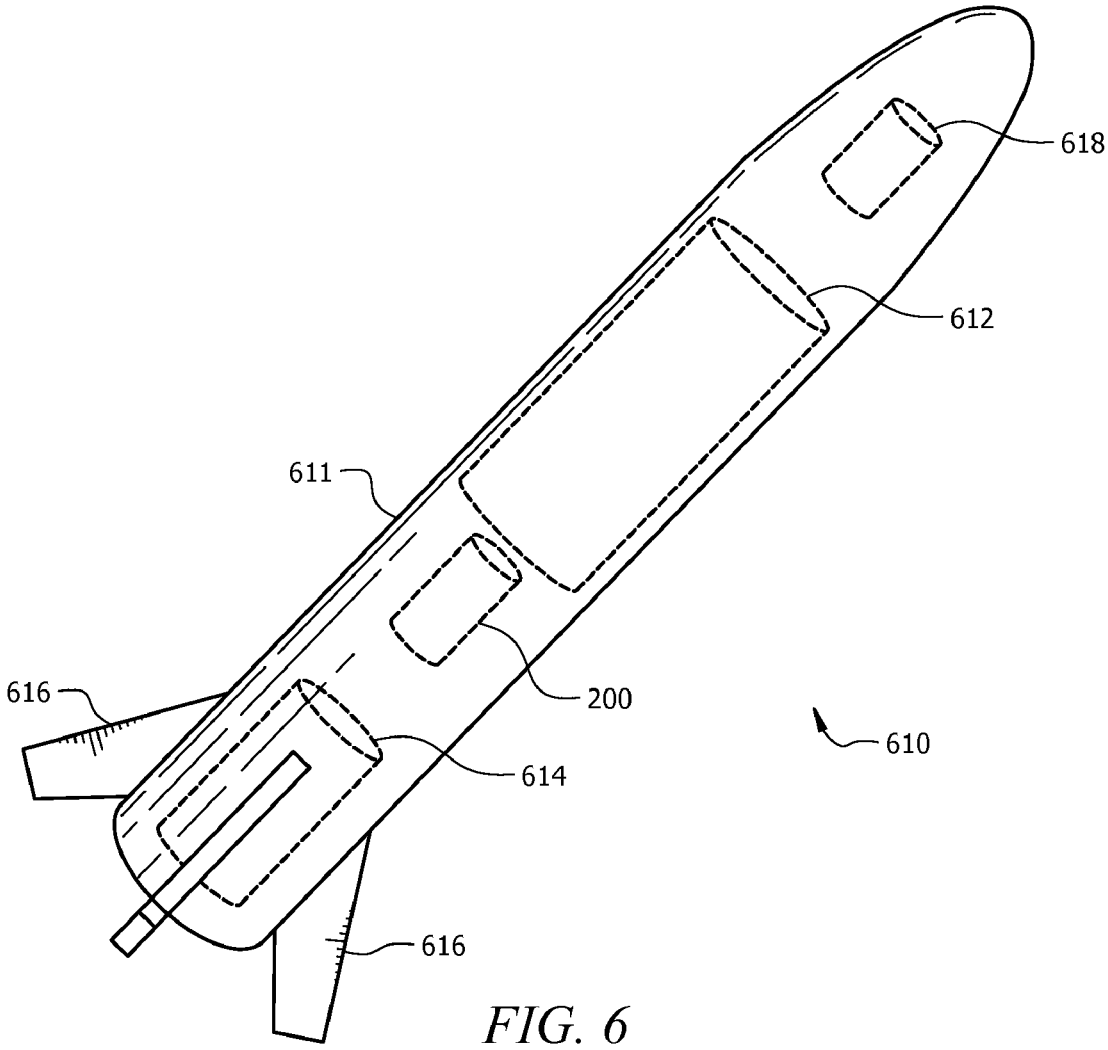
FIG. 6 shows a depiction of a penetrating weapon configured as a projectable device comprising an exemplary shock isolated fuze apparatus, according to an embodiment of the invention.

FIG. 6 shows a depiction of a penetrating weapon configured as a projectable device 610 comprising an exemplary shock isolated fuze apparatus 200, according to a disclosed embodiment. The projectable device 610 comprises a penetrating shell 611 and the shock isolated fuze apparatus 200 for igniting an explosive or other energetic material 612 when delivered to an intended target site. The projectable device 610 may include one or more fins 616, a propulsion device 614 and a guidance system 618 for guiding the projectable device 610 to an intended target as would be recognized by a person having skill in the art. However, the projectable device 610 need not necessarily be self-propelled, as it may be shot, launched or dropped toward an intended target.

As noted above, for fuze applications, disclosed embodiments enable usage of FZU armed legacy flange and compression mount fuzes with compliant shock isolation material. Such embodiments also allow access to FZU connector without damaging the compliant shock isolation material (i.e., no poking feed-through holes), and can maintain insensitive munition vent paths. Disclosed embodiments thus allow retrofit of legacy fuzes to reliably attack latest hardened targets. Moreover, although embodiments of the invention are generally described herein for protecting fuzes, such embodiments can be used more generally for providing bodies that generally include electronics 3D shock isolation, while allowing access to one end of the body, such as to make electrical and/or mechanical connection thereto. For example, instrumentation packages that are dropped from high altitude (e.g., weather instrumentation, remote environmental sensors), onboard recorded packages for high-g launch and impact events, and isolation of gun launched inertial navigation units.

EXAMPLES

Disclosed embodiments of the invention are further illustrated by the following specific Examples, which should not be construed as limiting the scope or content of this Disclosure in any way.

Figure 7:
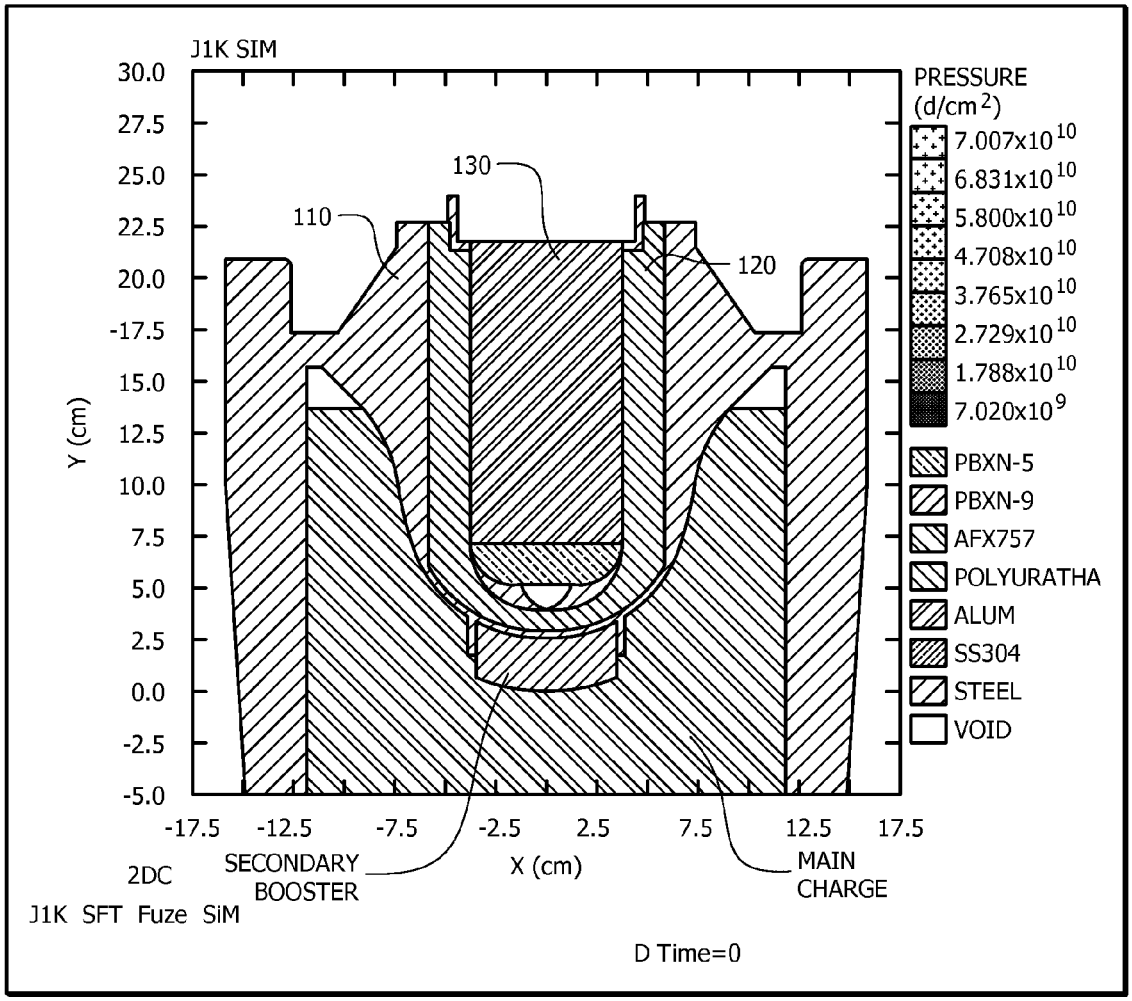
FIG. 7 show results from a CTH hydrocode (Sandia National Laboratories) simulation that evidences the booster train for a legacy fuze secured to a shock isolated fuzewell apparatus as disclosed herein having first and second boosters that ignite the main charge.

FIG. 7 show results from a CTH hydrocode (Sandia National Laboratories) simulation that evidences the booster train for a legacy fuze secured to a shock isolated fuzewell apparatus as disclosed herein having first and second boosters that ignite the main charge. The data shown indicates adequate shock margin for successful high order initiation of the main charge, that evidences the booster charge can penetrate through the layer of compliant material 120 without adversely affecting initiation of warhead.

While various disclosed embodiments have been described above, it should be understood that they have been presented by way of example only, and not as a limitation. Numerous changes to the disclosed embodiments can be made in accordance with the Disclosure herein without departing from the spirit or scope of this Disclosure. Thus, the breadth and scope of this Disclosure should not be limited by any of the above-described embodiments. Rather, the scope of this Disclosure should be defined in accordance with the following claims and their equivalents.

Although disclosed embodiments have been illustrated and described with respect to one or more implementations, equivalent alterations and modifications will occur to others skilled in the art upon the reading and understanding of this specification and the annexed drawings. While a particular feature may have been disclosed with respect to only one of several implementations, such a feature may be combined with one or more other features of the other implementations as may be desired and advantageous for any given or particular application.

The terminology used herein is for the purpose of describing particular embodiments only and is not intended to be limiting to this Disclosure. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this Disclosure belongs. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

We claim:

1. An apparatus for shock isolating an electronics package, comprising:

an outer member including an internal threaded portion;

a transition member including an external threaded portion and a hollow inner portion that defines a cavity configured for receiving said electronics package;

a layer of compliant shock isolation material positioned between said inner thread portion of said outer member and said external thread portion of said transition member, wherein said compliant shock isolation material encloses a front end and sidewalls of said transition member and is absent from its aft end to allow access to one end of the electronics package, and wherein said internal threaded portion of said outer member and said external threaded portion of said transition member are compliantly engaged via a gap provided by said layer of said compliant shock isolation material.

2. The apparatus of claim 1, wherein said compliant shock isolation material comprises a mixture including a compliant material and at least one other material having a density above that of said complaint material.

3. The apparatus of claim 2, wherein said mixture comprises an elastomer and at least one metal.

4. The apparatus of claim 2, wherein said outer member and said transition member comprise steel, and wherein a density of said mixture is within 20% of a combined density of said transition member and said electronics package.

5. The apparatus of claim 1, wherein said compliant shock isolation material comprises a mixture comprising an elastomer and at least one material having a density greater than a density of said elastomer, and wherein a density of said mixture is within 20% of a density of a combination of said transition member and said electronics package.

6. The apparatus of claim 5, wherein said electronics package comprise a fuze.

7. The apparatus of claim 1, wherein threads in said internal threaded portion of said outer member and threads in said external threaded portion of said transition member are thin walled and wherein said outer member and said transition member include a plurality of longitudinal ribs for adding mechanical strength.

8. The apparatus of claim 1, wherein a cross sectional shape of said internal threaded portion and said external threaded portion is square, triangular, rounded square or trapezoidal.

9. A shock isolated fuze assembly, comprising:

a shock isolated fuzewell apparatus, comprising:

a fuzewell including an internal threaded portion;

a transition member including an external threaded portion and a hollow inner portion that defines a fuzewell cavity configured for receiving said fuze;

a layer of compliant shock isolation material positioned between said inner thread portion of said fuzewell and said external thread portion of said transition member, wherein said compliant shock isolation material encloses a front end and sidewalls of said transition member and is absent from its aft end to leave said aft end exposed;

wherein said internal threaded portion of said fuzewell and said external threaded portion of said transition member are compliantly engaged via a gap provided by said layer of compliant shock isolation material;

a fuze in said fuzewell cavity, and a retaining element for securing an aft end of said fuze to said transition member.

10. The fuze assembly of claim 9, wherein said compliant shock isolation material comprises a mixture including a compliant material and at least one other material having a density above that of said complaint material.

11. The fuze assembly of claim 9, wherein said compliant shock isolation material comprises a mixture comprising an elastomer and at least one metal.

12. The fuze assembly of claim 11, wherein said fuze and said transition member comprises steel, and wherein a density of said compliant material is within 20% of a density of a combined density of said transition member and said electronics package.

13. The fuze assembly of claim 11, wherein said compliant shock isolation material comprises a mixture comprising an elastomer and at least one material having a density greater than a density of said elastomer, and wherein a density of said mixture is within 20% of a density of a combination of said transition member and said fuze.

14. The fuze assembly of claim 9, wherein threads in said internal threaded portion of said fuzewell and threads in said external threaded portion of said transition member are thin walled, and wherein said fuzewell and said transition member include a plurality of longitudinal ribs for adding mechanical strength.

15. The fuze assembly of claim 9, wherein a cross sectional shape of said internal threaded portion and said external threaded portion is square, triangular, rounded square or trapezoidal.

16. A projectable device, comprising:

a penetrating shell;

explosive or other energetic material within said shell, and a shock isolated fuze apparatus for igniting said explosive or other energetic material when delivered to an intended target site, wherein said shock isolated fuze apparatus comprises:

a fuzewell including an internal threaded portion;

a transition member including an external threaded portion and a hollow inner portion that defines a fuzewell cavity configured for receiving said fuze;

a layer of compliant shock isolation material positioned between said inner thread portion of said fuzewell and said external thread portion of said transition member, wherein said compliant shock isolation material encloses a front end and sidewalls of said transition member and is absent from its aft end to leave said aft end exposed, and wherein said internal threaded portion of said fuzewell and said external threaded portion of said transition member are compliantly engaged via a gap provided by said layer of said compliant shock isolation material.

17. The projectable device of claim 16, wherein said compliant shock isolation material comprises a mixture including a compliant material and at least one other material having a density above that of said complaint material.

18. The projectable device of claim 17, wherein said fuze and said transition member comprise steel, and wherein a density of said mixture is within 20% of a combined density of said transition member and said electronics package.

19. The projectable device of claim 18, wherein said mixture is within 10% of said combined density.

20. The projectable device of claim 16, wherein threads in said internal threaded portion of said fuzewell and threads in said external threaded portion of said transition member are thin walled, and wherein said fuzewell and said transition member include a plurality of longitudinal ribs for adding mechanical strength.

* * * * *